US006071345A

United States Patent [19]

Stuart

[11] Patent Number: 6,071,345

[45] Date of Patent: Jun. 6, 2000

[54] SEAL STRIP COATING APPARATUS

[75] Inventor: Warner Hugh Stuart, Thatcher, Id.

[73] Assignee: Bryce Corporation, Memphis, Tenn.

[21] Appl. No.: 09/102,320

[22] Filed: Jun. 22, 1998

Related U.S. Application Data

[63] Continuation-in-part of application No. 08/853,407, May 9, 1997, Pat. No. 5,768,993.

[51] Int. Cl.[7] ..... B05C 1/08; B05C 21/00

[52] U.S. Cl. ..... 118/602; 118/603; 118/610; 118/61; 118/251; 118/261; 427/294

[58] Field of Search ..... 118/61, 251, 261, 118/602, 603, 610; 156/578; 427/294

[56] References Cited

U.S. PATENT DOCUMENTS

| | | | |
|---|---|---|---|
| 3,540,409 | 11/1970 | Lloyd | 118/6 |
| 3,818,830 | 6/1974 | Schultz | 101/350 |
| 4,198,446 | 4/1980 | Goetz | 118/249 X |
| 4,245,583 | 1/1981 | Schollkopf et al. | 118/259 |
| 4,290,362 | 9/1981 | Kobler et al. | 101/350 |
| 4,960,482 | 10/1990 | Crane et al. | 118/46 X |
| 5,010,817 | 4/1991 | Grosshauser | 101/350 |
| 5,121,689 | 6/1992 | Fadner | 101/365 |
| 5,189,956 | 3/1993 | Reder et al. | 101/364 |
| 5,213,044 | 5/1993 | Elia et al. | 101/483 |
| 5,406,887 | 4/1995 | Hertel et al. | 101/366 |
| 5,628,868 | 5/1997 | Marschke et al. | 118/261 X |
| 5,768,993 | 6/1998 | Stuart | 101/366 |

*Primary Examiner*—Milton Cano
*Attorney, Agent, or Firm*—Luedeka, Neely & Graham, P.C.

[57] ABSTRACT

An apparatus for coating a strip of liquid material such as a polymer adhesive onto the surface of a traveling web at adjustable cross-directional locations which includes a transfer roll secured to a drive shaft coupled hub by an asymmetric rim plate. A carrier sleeve is secured to the hub by anti-friction bearings for independent rotation about the axis of the drive shaft. A fountain housing is secured to the carrier sleeve. The fountain housing supports a fountain nozzle for pressurized discharge of a fluid onto the perimeter surface of the transfer roll within an evacuated cavity. The cavity perimeter around the fountain nozzle has a close, sealing proximity with the transfer roll surface. An adjustable doctor blade screeds excess liquid on the transfer roll surface into the evacuated cavity for removal by a vacuum system. The apparatus significantly reduces the emissions of volatile fluids to the atmosphere during the coating process.

18 Claims, 4 Drawing Sheets

SEAL STRIP COATING APPARATUS

This application is a continuation-in-part of application Ser. No. 08/853,407 filed May 9, 1997 now U.S. Pat. No. 5,768,993.

FIELD OF THE INVENTION

The present invention relates to apparatus for coating a strip of polymer adhesive onto a longitudinally traveling web in preparation of bonding the web to itself or to another web of the same or similar material.

BACKGROUND OF THE INVENTION

Many procedures for manufacturing flexible polymeric containers such as plastic bags include the process of forming a continuous tubular enclosure by folding a traveling web of polymer film material upon itself and sealing the juxtaposed edges together. The sealing step may be accomplished by heat sealing or by use of an adhesive. The adhesive sealing procedure includes the step of applying a continuous strip of adhesive to the traveling web as a narrow coating. This strip of adhesive is laid onto the web as a viscous liquid film that is transferred from an anilox roll for example in rolling contact with the traveling web.

Some of the more effective adhesive compositions necessarily include volatile, combustible solvents. After the adhesive is coated onto the web at the desired location, the solvent is removed from the coated strip by evaporation leaving the stable adhesive solids. Subsequently, the web is slit, turned upon itself and the edges laid together. The strip of adhesive is heated under compressive pressure to activate the adhesive and seal the edges together.

Volatile, combustible solvents frequently constitute a health hazard as well as a safety hazard in the industrial environment. Accordingly, it is essential to users of these materials to keep the generally occupied plant environment substantially free of fugitive vapors. To this end, web processing machines using these materials are usually covered by ventilation hoods or more comprehensive enclosures that discharge environmental air drawn from around the machine into a vapor recovery system. Even so, vapor recovery is an expensive overhead cost to the manufacturing process. Given the value of the process, it would be considerably less expensive to restrict the release of such vapors than to recover them after release. However, the manufacturing process requires a continuously traveling web which frustrates many efforts to limit release of harmful solvent vapors.

An example of difficulties encountered by vapor control efforts arises from the prior art process by which an adhesive strip is coated onto the polymer web. This prior art process includes an anilox roll that extends the full width or cross direction of the production machine. Such width may be five to ten feet, for example. The polymer web width carried in a typical bag machine, for example, may represent several tubes, each of which is to receive, for example, a ½ inch wide coating of adhesive along the length of the web. For example, if 5 tubes are to be formed from an 8 ft. wide web, the total width of adhesive coating applied to the web is only 2½ in. In order to apply 5, ½ in. wide continuous strips of adhesive to the web, an 8 ft. long (machine width) anilox roll rotating in an 8 ft. long open pan of the solvent diluted adhesive is used. Much of the adhesive picked up by the anilox roll surface is immediately doctored from the roll surface except for the selectively positioned ½ in. bands of adhesive. Unless the entire roll and pan are covered and connected to a vapor recovery system, the open atmosphere exposure of the adhesive pond in the pan may release a large amount of solvent vapors to the surrounding environment.

It is important to understand that the exact position, number and width of the adhesive strips may frequently change depending on the specification and quantity of product being manufactured on a particular day or hour. Hence, although the entire 8 ft. length of the anilox roll may be used to apply adhesive over an extended time frame, only a few inches of the roll length may be used at any given moment.

It is therefore, an object of the present invention to reduce the quantity of fugitive vapor released by web processing environment.

Another object of the present invention is to secure greater control over the release of fugitive solvent vapors from a web processing machine.

Also an object of the present invention is to provide an adhesive application apparatus having minimal solvent release.

A further object of the invention is to provide an improved adhesive coating strip application apparatus.

It is also an object of the present invention to capture and confine fugitive vapors from an anilox transfer roll at the point of release.

Another object of the invention is to provide a cost effective process for disposing of fugitive solvent vapor.

A still further object of the invention is to provide a system for recovering energy values from fugitive solvent vapor emitted from a continuous web coating process.

SUMMARY OF THE INVENTION

To address these objectives and others as will be apparent from the following detailed description of the invention, the invention provides an apparatus for depositing a film of adhesive onto the rotating surface of a film transfer roll such as an anilox roll. By rolling contact and surface adhesion, a desired portion of the film deposited on the transfer roll surface is redeposited onto the surface of a traveling web as a continuously coated strip of adhesive.

The film transfer apparatus comprises an adhesive fluid fountain nozzle. The nozzle is controllably positioned in close proximity with the transfer roll surface to provide a minimum fluid by-pass gap between the extremity surfaces around the nozzle discharge orifice and the roll surface.

The cross-machine length of the nozzle and the cooperating transfer roll are respectively sized for applying the desired width of coating strip to the traveling web.

The nozzle is structurally secured within a fountain housing having a cavity that opens to a sealing face surface of the housing. The housing position is secured to place the housing seal face in close proximity with the transfer roll surface. The nozzle discharge orifice is surrounded by the cavity opening.

Adhesive fluid flow to the nozzle is delivered from a remote reservoir under pressure by a supply pump. The adhesive fluid delivery pressure and flow rate is regulated to drive the fluid into the anilox cells on the transfer roll surface. Excess adhesive that escapes across the gap between the nozzle extremities and the transfer roll surface flows into the surrounding cavity. An adjustable doctor blade screeds additional excess adhesive from the transfer roll surface. The cavity is maintained under a subatmospheric pressure of from about 30 in. $H_2O$ to about 40 in. $H_2O$. Excess liquid adhesive, fugitive solvent vapor from the adhesive and influx air entering cavity past the housing seal face is caused by the subatmospheric pressure to flow through an evacuation conduit connected to the cavity and into a gas/liquid vacuum separation chamber. Recovered excess liquid adhesive may be returned to the adhesive supply reservoir from the separation chamber. Solvent vapors from the separation chamber are preferably delivered to a combustion device such as an incinerator, boiler, water heater or other combustion apparatus for destruction of the vapors and/or heat recovery from the combustion thereof.

The fountain housing is preferably fabricated from a material having a high thermal conductivity coefficient such as brass or aluminum. A water jacket within the housing contributes to the adhesive flow control by heating the adhesive to reduce its viscosity. Heat energy obtained by combusting the solvent vapor may be used to heat water circulated through the housing water jacket.

The transfer roll is non-rotatively secured to a powered drive shaft and therefore rotates with the drive shaft. For a transfer roll having an axial length less than the web width it is preferred to provide a means for rapid axial repositionment of the roll along the drive shaft length to any desired location.

The fountain housing is secured by a flange bracket to a bearing mounted sleeve that is freely rotatable about a bearing boss portion of the transfer roll. This bearing is preferably placed in substantial planar alignment with the transfer roll plane.

BRIEF DESCRIPTION OF THE DRAWINGS

Additional features, objects and advantages of the invention will be learned from the following detailed description of a preferred embodiment of the invention supported by the drawings in which.

DESCRIPTION OF THE PREFERRED EMBODIMENTS

Figure 1:
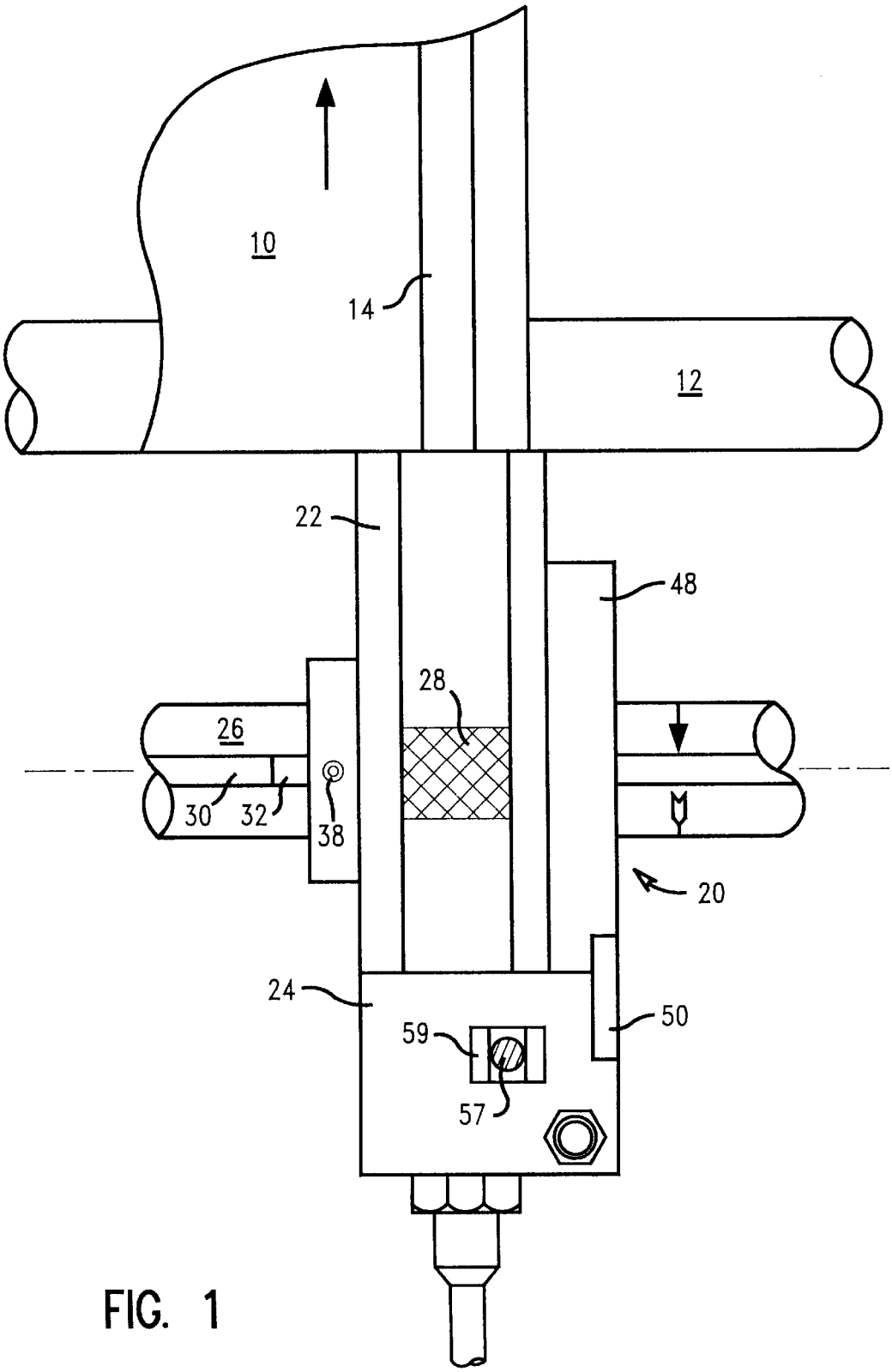
FIG. 1 is a plan view of the invention in operating combination with a traveling web.
Figure 2:
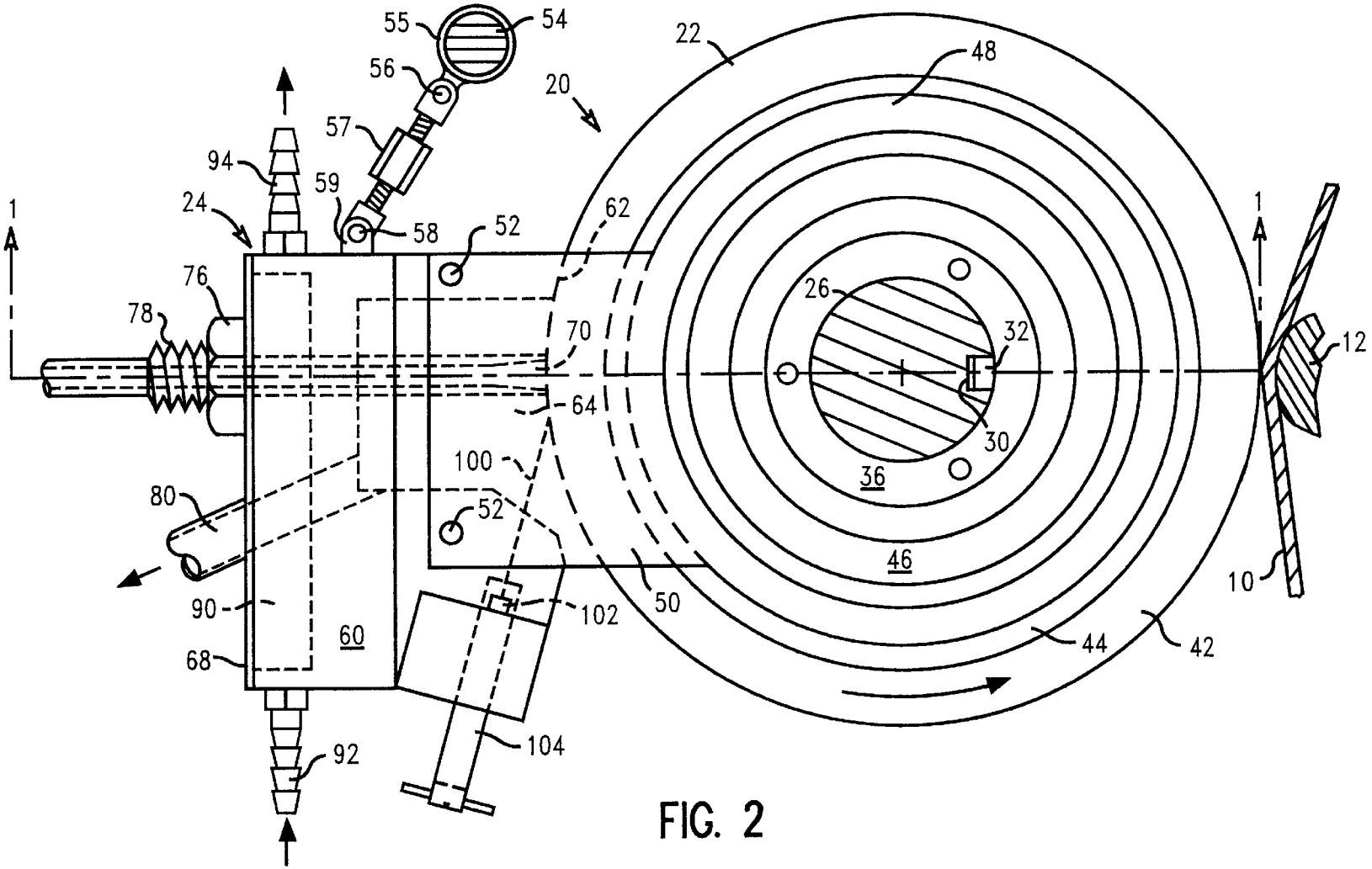
FIG. 2 is a side elevational view of the invention.
Figure 3:
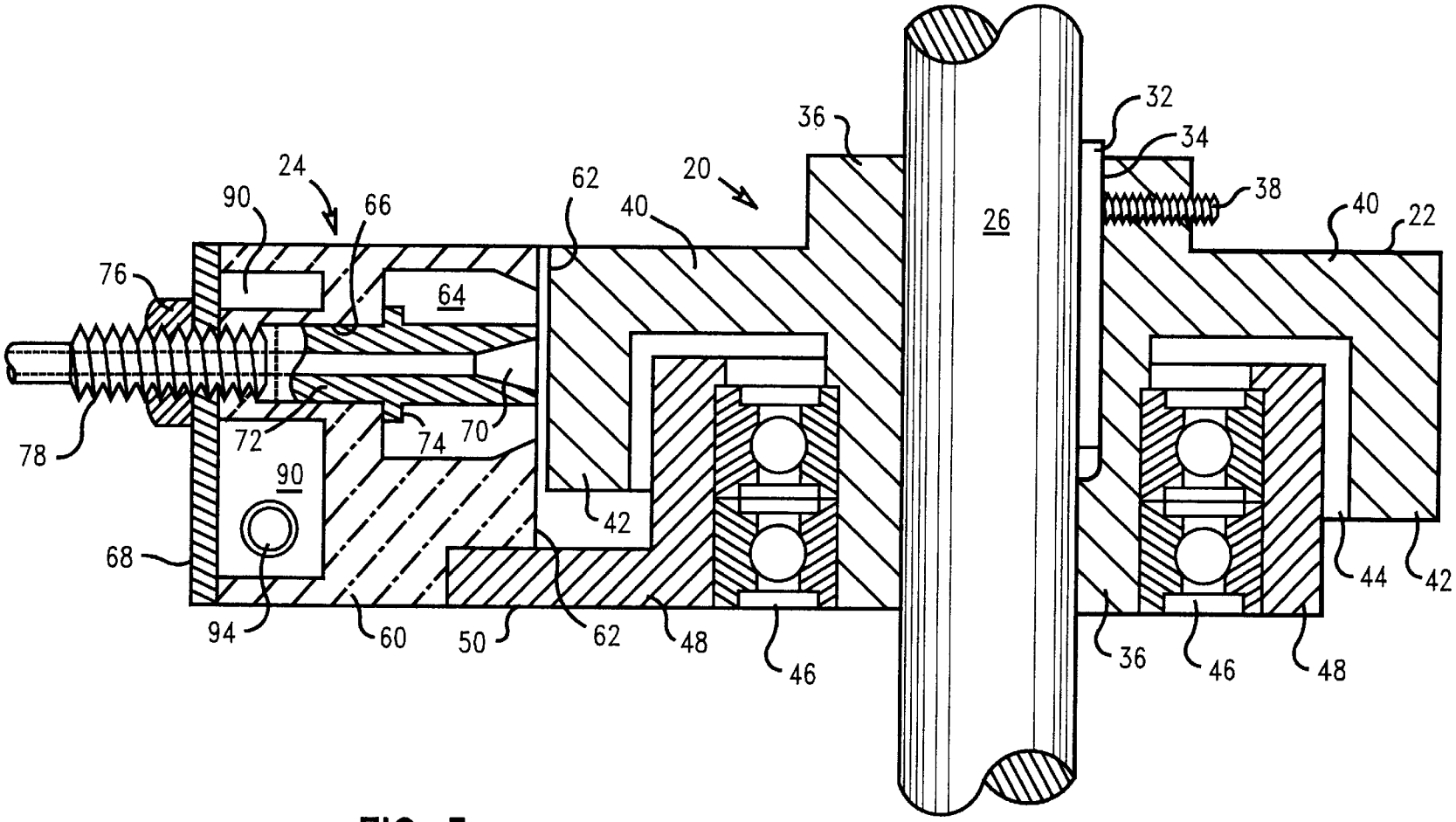
FIG. 3 is a sectional view of the invention along cutting plane 1—1 of FIG. 2; and, FIG. 4 is a fluid flow schematic for the invention.

With respect to the drawings wherein like reference characters designate like or similar elements throughout the several figures of the drawing, FIG. 1 illustrates a traveling web 10; preferably a polymer film. A coating assembly 20 is positioned to apply a continuous strip of adhesive 14 to the web 10 as the web is turned in tightly drawn contact with a turning roll 12. The adhesive strip 14 is applied to the web 10 by surface tension contact with an adhesive layer on the surface of transfer roll 22. There are several types of suitable print or fluid transfer rolls but a preferred embodiment of the invention utilizes an anilox roll having a gravure cell pattern 28.

The transfer roll 22 is rotatively driven by shaft 26 at an angular velocity appropriate for the required surface speed. Depending on many material factors, the surface speed of the transfer roll 22 may be more, less or the same as the speed of web 10. A first key slot 30 confines a key 32 that projects into corresponding second key slot 34 within the integral substance of the transfer roll hub 36. A set-screw 38 secures the key 32 longitudinal position within the slots 30 and 34.

An asymmetric or off-center rim plate 40 structurally connects the hub 36 to the transfer roll rim 42. An annular space 44 is thereby provided between the outer cylindrical surface of the hub 36 and the inner surface of the rim 42.

Within the annular space 44, antifriction bearings 46 rotationally link a bearing sleeve 48 with the transfer roll hub 36. This rotational linkage between the hub and sleeve is substantially free whereby the bearing sleeve 48 may be held at a non-rotating position while the transfer roll 22 is driven by the rotating shaft 26. Simultaneously, the bearing sleeve 48 is positionally secured in radial and axial directions.

Flange bracket 50 is a radial extension of the bearing sleeve 48 for structural attachment of the fountain assembly 24 by suitable fasteners such as machine screws 52.

The fountain assembly 24 comprises a complex housing 60 that is preferably fabricated from a high heat transfer rate material such as brass or aluminum. A seal face 62 on the fountain housing is formed to correspond with the outer surface curvature of the transfer roll rim 42. Preferably, this seal face 62 is positioned to provide less than 0.005 in. clearance between the housing face 62 and the perimeter surface of rim 42.

Within the fountain housing 62, a vacuum cavity 64 is formed as a boring or cast depression that opens to the housing seal face 62. A nozzle aperture 66 in the housing body receives the shank 72 of a fountain nozzle 70. An abutment shoulder 74 is strategically positioned along the shank length to secure the distal elements of the fountain nozzle discharge orifice that are most proximate to the transfer roll surface at a desired stand-off distance; for example, about 0.005 in. to about 0.010 in. A threaded nut 76 engaged with screw threads 78 on the nozzle shank and turned against the housing backplate 68 secures the abutment shoulder 74 against the adjacent housing shoulder. It will be understood that the stand-off proximity of the nozzle 70 from the transfer roll surface may be adjusted by means of shim rings not illustrated between the abutment shoulder 74 and the housing body.

The vacuum cavity 64 is also penetrated by a vacuum conduit aperture 80. The purpose and operation of this conduit will be explained hereafter relative to the process schematic of FIG. 4.

The fountain housing 60 includes a water jacket cavity 90 that is covered by the backplate 68. Water circulation conduit fittings 92 and 94 connect the water jacket 90 to a hot water circulation loop further described relative to FIG. 4.

A doctor blade 100 that is secured in an adjustable blade holder apparatus 102 screeds excess adhesive deposited on the transfer roll by the fountain nozzle 70. As the fountain nozzle deposited coating of adhesive on the transfer roll surface is carried by rotation of the roll against the doctor blade edge, excess fluid is sheared from the coat thickness by the blade edge. A threaded lead screw 104 provides a mechanism for manual micrometer adjustments to the blade 100 position. Blade 100 position may also be adjusted automatically using, for example a pneumatic tube or synchronous motor or other devices known by those of ordinary skill in the art. The doctor blade 100 is also an operative element of the perimeter seal around the vacuum cavity 64.

Shear forces are generated by the screeding operation of the doctor blade 100 on the transfer roll carried adhesive. These shear forces translate to a torque on the fountain assembly 24. This torque tends to rotate the fountain assembly with the transfer roll 20 notwithstanding the antifriction bearings 46. Normally, the shear force and transmitted torque is small and adequately countered by the service conduit connections to the fountain assembly. There are occasions and circumstances, however, for which it may be useful to secure the angular position of the fountain assembly about the drive shaft 26. For this purpose, the fountain housing 60 may be provided with a clevis bracket 59 having a journal pin 58 connection to one end of a turnbuckle link 57. The opposite end of the turnbuckle is connected by journal pin 56 to a tether ring 55. The tether ring is radially retained by an anchor shaft 54 but is free for longitudinal movement along the length of the anchor shaft 54. This turnbuckle 57 mechanism provides a countertorque mechanism and an adjustment structure for securing the angular position of the fountain assembly 24 about the drive shaft 26.

Figure 4:
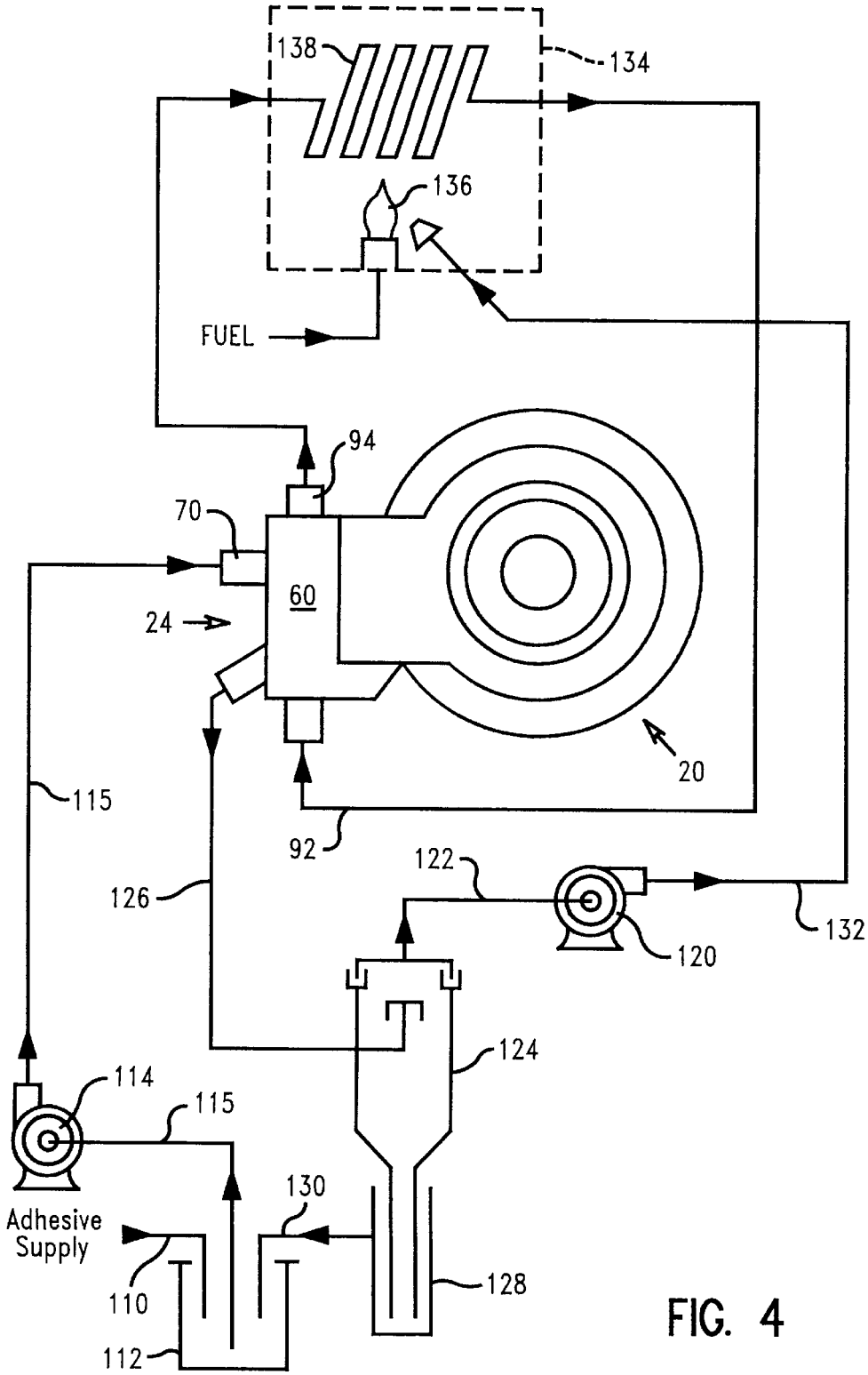

The simplified process schematic of FIG. 4 provides an adhesive system that comprises a primary source of material supply 110 to an active circulation reservoir 112. Although represented as a flow stream, it will be understood that the supply source 110 may also be batches or incremental quantities of adhesive that are manually deposited in the reservoir 112. A pump 114 and suction line 115 extracts the adhesive from the reservoir 112 for pressurized delivery into a supply conduit 115. The supply conduit is connected to the fountain nozzle 70.

Vacuum source 120 represents a suitable vacuum generation device such as a vacuum pump, vacuum fan or eductor. Preferably, the vacuum source 120 will provide a subatmospheric pressure in cavity 64 in the fountain housing ranging from about 30 in. $H_2O$ to about 40 in $H_2O$. The vacuum source suction line 122 is connected to a gas/liquid separator apparatus 124 having a baffled inlet 126 and a liquid sealed outlet 128. A liquid discharge conduit 130 may be connected to direct recovered adhesive back into the circulation reservoir 112. Not shown but understood by those of skill in the art are those instruments and machines that monitor the adhesive constituency and control the addition of supplemental solvent to the reservoir.

The volumetric flow capacity of the vacuum source 120 is determined predominantly by the fountain housing 60 size and the desired gap at the interface between the transfer roll surface and the seal face 62 of the housing. The operational objective is to maintain an overall inflow of atmosphere gases such as air into the vacuum cavity 64 thereby precluding the loss of fugitive solvent vapor into the surrounding atmosphere from the fountain assembly. Such solvent vapor will escape from the transfer roll surface over the rotational arc that is removed from the fountain assembly but these losses normally are relatively small and best accommodated by the general machine ventilation system. Vapor emissions from the transfer roll surface may also be reduced by rotatively positioning the fountain assembly 24 in closer proximity with web 10 and turning roll 12. As required, the amount of solvent in the adhesive may also be adjusted to account for atmospheric losses from the transfer roll surface as the fountain assembly 24 is placed closer to or further away from the web 10 or turning roll 12.

The gaseous discharge from the vacuum source 120 through conduit 132 comprises a vapor blend of solvent and air. If the solvent is a combustible volatile, the vapor blend may be combustible depending on the air-to-fuel ignition ratio and other stoichiometric factors. Accordingly, the discharge conduit 132 is preferably channeled to a combustion appliance 134 having a standing flame 136 fueled by an external supply. Preferably, the appliance 134 is a hot water heater 138 in circulation loop with the fountain housing water jacket 90. Alternatively, the discharge conduit 132 may be directed to a waste incinerator.

Other, more complex, solvent recovery systems are also suitable for use with the invention such as chilled condensation and activated carbon adsorption systems. Those of ordinary skill in the art will know the detailed mechanics of such solvent recovery systems and how the solvent recovery operations of this invention may be integrated with a larger system.

A multiplicity of the aforedescribed coating assemblies 20 may be driven by a single drive shaft 26. Discretionary placement of each assembly along the length of shaft 26 is quickly and easily accomplished by retracting the set screw 38. Such retraction of the set screw relieves the compression on spline key 32 thereby permitting the coating assembly to be axially repositioned. To this end, it is also to be understood that the conduits 92, 94, 115 and 126 are preferably flexible hose elements having sufficient length and size for lateral shifting of the coating assembly 20 along the drive shaft length. Hence, production specifications may be quickly changed without compromise of the invention objectives.

The foregoing description of preferred embodiments of my invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

As my invention, therefore,

I claim:

1. An apparatus for applying a fluid coating to a traveling web, said apparatus comprising:

a rotationally driven transfer roll having a liquid coating transfer surface;

a fountain housing having a seal face proximate to said transfer surface;

means for securing said housing to said transfer roll for relative rotation therebetween whereby said housing is held substantially stationary relative to said transfer roll and the rotation thereof;

a vacuum cavity in said fountain housing in flow communication with an opening between said housing seal face; and said transfer roll;

a fountain nozzle having a fluid discharge orifice positioned closely proximate to said transfer surface within the opening of said vacuum cavity;

means for supplying a flow of fluid to said fountain nozzle for discharge onto said transfer surface;

means for screeding an excess of said fluid from said transfer surface within said vacuum cavity; and means for providing a subatmospheric pressure within said vacuum cavity to flow air, vapors and said excess liquid from said vacuum cavity.

2. An apparatus as described by claim 1 further comprising means to separate the air, vapors and fluid flowing from said vacuum cavity into respective liquid and vapor flow streams.

3. An apparatus as described by claim 2 wherein said vapor flow stream is channeled to a combustion appliance.

4. An apparatus as described by claim 3 wherein said combustion appliance is an incinerator.

5. An apparatus as described by claim 3 wherein said combustion appliance is a furnace.

6. An apparatus as described by claim 3 wherein said liquid flow stream is combined with a supply flow of fluid to said fountain nozzle.

7. An apparatus as described by claim 2 wherein said vapor flow stream is directed to a vapor recovery system.

8. An apparatus as described by claim 1 wherein said transfer roll includes hub means secured to a drive shaft for rotationally driving said transfer roll about a substantially common rotational axis.

9. An apparatus as described by claim 8 wherein said means for securing said fountain housing to said transfer roll comprises an anti-friction bearing disposed between said hub means and a substantially non-rotating sleeve means.

10. An apparatus as described by claim 9 wherein said means for securing said fountain housing to said transfer roll comprises a flange bracket secured to said fountain housing and to said non-rotating sleeve means.

11. An apparatus for applying an adhesive to the surface of a traveling web, said apparatus comprising:

a drive shaft having an axis of rotation;

a transfer roll having a liquid film transfer surface and a drive coupling, said drive coupling being non-rotatively secured to said drive shaft for rotational drive of said transfer surfaces about said axis of rotation;

a carrier sleeve secured to said drive coupling for rotation about said axis independent of said drive coupling;

a fountain housing secured to said carrier sleeve, said housing having a seal face positioned in close proximity with said transfer surface, said seal face circumscribing a vacuum cavity within said housing;

a fountain nozzle having a liquid discharge orifice disposed within said cavity, said discharge orifice being positioned in close proximity with said transfer surface and circumscribed by said seal face;

vacuum means for providing a subatmospheric pressure in said vacuum cavity; and supply means for directing a pressurized flow stream of adhesive to said fountain nozzle.

12. An apparatus as described by claim 11 wherein said seal face comprises a doctor blade for screeding excess liquid from said transfer surface.

13. An apparatus as described by claim 12 comprising a water jacket in said fountain housing in flow connection with a heated water supply for heating said fountain housing.

14. An apparatus as described by claim 13 wherein said heated water supply is provided by an apparatus which includes a fuel source connected in fluid flow communication with said vacuum means.

15. An apparatus as described by claim 14 wherein said vacuum means comprises means for separating vapors from liquids, said vapors being directed to said heated water supply apparatus as a fuel source.

16. An apparatus as described by claim 11 wherein said vacuum means comprises means for separating vapors from liquids.

17. An apparatus as described by claim 16 wherein said vacuum means is connected in fluid flow communication with a means for burning said separated vapors.

18. An apparatus as described by claim 16 wherein said vacuum means is connected in fluid flow communication with a means for recovering said separated vapors.

* * * * *

UNITED STATES PATENT AND TRADEMARK OFFICE

CERTIFICATE OF CORRECTION

PATENT NO. : 6,071,345
DATED : June 6, 2000
INVENTOR(S) : Warner Hugh Stuart

It is certified that error appears in the above-identified patent and that said Letters Patent is hereby corrected as shown below:

Column 1,
Line 23, after "roll" and before "for" add a comma (,).
Line 24, after "example" and before "in" add a comma (,).
Line 55, after "ten" delete "feet" and insert -- ft. --.
Line 57, after "½" delete "inch" and insert -- in. --.

Column 2,
Line 7, after "manufactured" delete "on" and insert -- during --.
Line 13, after "by" and before "web" insert -- the --.
Line 34, after "others" add a comma (,).
Line 47, after "the" and before "roll" insert -- transfer --.
Line 59, after "rate" delete "is" and insert -- are --.

Column 3,
Line 1, after "entering" and before "cavity" insert -- the --.
Line 16, after "heat" and before "water" insert -- the -- and
after "solvent" delete "vapor" and insert -- vapors --.
Line 20, after "width" insert a comma (,).
Line 50, after "as the web" and before "is turned" insert -- 10 --.

Column 4,
Line 5, after "between the hub" and before "and sleeve" insert -- 36 -- and
after "and sleeve" insert -- 48 --.
Line 18, after "housing" and before "is" insert -- 60 --.
Line 20, delete "housing" and insert -- seal --.
Line 23, after "housing" delete "62" and insert -- 60 --.
Line 32, after "shank" and before "and" insert -- 72 --.
Line 37, after "rings" insert a comma (,) and
after "illustrated" insert a comma (,).
Line 41, after "conduit" and before "will" insert -- 80 --.
Line 50, after "roll" and before "by" insert -- 22 --.
Line 52, after "roll" and before "against" insert -- 22 --.
Line 53, after "blade" and before "edge" insert -- 100 --.
Line 54, after "blade" and before "edge" insert -- 100 --.
Line 57, after "for example" insert a comma (,).
Lines 64 and 65, after "assembly" and before "with" insert -- 24 --.

Column 5,
Line 1, after "assembly" and before the period (.) insert --24 --.
Lines 4 and 5, after "assembly" and before "about" insert -- 24 --.

UNITED STATES PATENT AND TRADEMARK OFFICE

CERTIFICATE OF CORRECTION

PATENT NO. : 6,071,345
DATED : June 6, 2000
INVENTOR(S) : Warner Hugh Stuart

It is certified that error appears in the above-identified patent and that said Letters Patent is hereby corrected as shown below:

Line 7, after "turnbuckle" and before "is" insert -- 57 --.
Line 8, after "ring" and before "is" insert -- 55 --.
Line 21, after "115" delete "extracts" and insert -- extract --.
Line 23, after "conduit" and before "is" insert -- 115 --.
Line 28, after "housing" and before "ranging" insert -- 60 --.
Line 34, after "Not shown" insert a comma (,).
Line 35, after "in the art" insert a comma (,).
Line 37, after "reservoir" and before the period (.) insert -- 112 --.
Lines 40 and 41, after "roll" and before "surface" insert -- 22 --.
Line 41, after "housing" and before the period (.) insert -- 60 --.
Line 45, after "assembly" and before the period (.) insert -- 24 --.
Line 46, after "roll" and before "surface" insert -- 22 --.
Lines 47 and 48, after "assembly" and before "but" insert -- 24 --.
Line 50, after "roll" and before "surface" insert -- 22 --.
Line 55, after "roll" and before "surface" insert -- 22 --.

Column 6,
Line 13, after "assembly" and before "to" insert -- 20 --.
Line 18, after "shaft" and before "length" insert -- 26 --.

Claims,
Column 6,
Line 50, after "face" and before "and" delete the semicolan (;).

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*